US005727404A

United States Patent [19]

Cho

[11] Patent Number: 5,727,404

[45] Date of Patent: Mar. 17, 1998

[54] WASHING MACHINE WITH A DOUBLE PULSATOR

[75] Inventor: In-Su Cho, Kwangju, Rep. of Korea

[73] Assignee: Daewoo Electronics Co., Ltd., Seoul, Rep. of Korea

[21] Appl. No.: 766,257

[22] Filed: Dec. 13, 1996

[30] Foreign Application Priority Data

Dec. 15, 1995 [KR] Rep. of Korea ..... 95-50630

[51] Int. Cl.[6] ..... D06F 17/08; D06F 17/10

[52] U.S. Cl. ..... 68/133; 68/134

[58] Field of Search ..... 68/133, 134

[56] References Cited

U.S. PATENT DOCUMENTS 4,434,630 3/1984 Ikeda ..... 68/53 X

FOREIGN PATENT DOCUMENTS 146575 6/1989 Japan ..... 68/134

2 094 839 3/1981 United Kingdom .

*Primary Examiner*—Philip R. Coe

*Attorney, Agent, or Firm*—Lowe, Price, LeBlanc & Becker

[57] ABSTRACT

An outer pulsator mounted on a bottom of a washing tub has a hollow protruding part protruded upwardly at a center thereof and a bottom plate extended radially from a lower skirt of the protruding part. An inner pulsator is installed inside of the protruding part. A gear part has an inner gear formed under the inner pulsator, an internal gear formed under the outer pulsator, and an intermediate gear engaged between the inner gear and the internal gear. When the inner gear is rotated by the driving motor, the internal gear is rotated in a reverse direction to a rotating direction of the inner gear by intermediate gear therebetween. A current generated by the inner pulsator goes through communication holes of the protruding part of the outer pulsator and then breaks a reverse current generated by the outer pulsator, so that laundry articles are prevented from tangling and twisting. Therefore, laundry articles are washed by being beaten with random and irregular water currents without damage.

7 Claims, 3 Drawing Sheets

WASHING MACHINE WITH A DOUBLE PULSATOR

BACKGROUND OF THE INVENTION

1. Field of the Invention

The present invention relates to a washing machine, and more particularly to a washing machine with a double pulsator in which a heart-shaped vortex current generated by an outer pulsator is broken by an inner pulsator in order to prevent tangling and twisting of laundry articles.

2. Prior Art

Generally, washing machines are classified into a vortex-type washing machine, a stirrer-type washing machine, and a drum-type washing machine according to the washing manner.

Among those washing machines, the vortex-type washing machine is provided with a pulsator rotatably mounted on the bottom of its washing tub. The pulsator is rotated by driving the motor. The rotation of the pulsator generates the vortex current of the washing water in the washing tub. The vortex current strikes the laundry articles, whereby they are rotated to be washed. The vortex-type washing machines are divided into one-tub-type washing machines and two-tub-type washing machines.

The stirrer-type washing machine is provided with a washing rod called an agitator which is disposed at the center of the washing tub. When the washing rod is regularly rotated, the water current is generated by the bladed washing rod, and the laundry articles make contact with the washing rod and the wall of the washing tub, thereby being washed.

Compared with the vortex-type washing machine, the stirrer-type washing machine has better cleaning efficiency, causes less tangling of the laundry articles, and allows a larger volume of laundry due to the bladed washing rod rotated at its center. Still it is improper to wash a massive laundry article by the washing rod because the contact area between the laundry and the washing tub is increased so the cloth of the laundry can be damaged.

The drum-type washing machine is provided with a cylindrical drum having a plurality of washing water communication holes inside the stationary tub. The cylindrical drum is so disposed that its revolving shaft of longitudinal direction is parallel to the surface of the washing water in the stationary tub. When washing, this drum revolves on the revolving shaft of longitudinal direction, and the laundry articles revolve about the revolving shaft by hanging on projections formed on the inner surface of the cylindrical drum. Thereby they become washed. The drum-type washer is recommended for washing a large volume of laundry articles.

Among the above-mentioned washing machines, the vortex-type washer is generally used for domestic use, and recently an automatic washer consisting of a one-tub-type washer in which washing and dehydration are carried out in the same tub has been commonly used.

Hereinafter, the conventional one-tub-type washer of the vortex-type washing machines will be described in detail with reference to FIG. 1.

FIG. 1 is a schematic cross-sectional view of a one-tub type washing machine having a pulsator according to the prior art.

As shown in FIG. 1, reference numeral 10 denotes a stationary washing tub, in which a rotating shaft 60 is upwardly installed at the center of the bottom thereof, and a washing tub 20 is connected with rotating shaft 60. Washing tub 20 has a plurality of washing water communication holes. A pulsator 30 is rotatably placed on the bottom of the washing tub 20 for generating a vortex current. A driving part 40 having a motor 41 and clutch assembly 43 is installed at a predetermined position of the lower part of the outside of stationary tub 10 in order to drive washing tub 20 and pulsator 30.

The washing water received in stationary tub 10 is rotated by revolution of pulsator 30, thereby the laundry articles become washed.

The revolution of the above-mentioned conventional pulsator 30 generates a heart-shaped vortex current which rises along the wall of washing tub 20 and then falls toward the center of washing tub. Washing by the vortex current has good cleaning efficiency. However, since the current forms a circle in the horizontal plane, the laundry articles become tangled and twisted with each other. Therefore, there is problem that certain cloth can be easily damaged when washing thin and soft clothes.

SUMMARY OF THE INVENTION

The present invention has been made to overcome the above-described problems of the prior art, and accordingly it is an object of the present invention to provide a washing machine with a double pulsator in which a heart-shaped vortex current generated by an outer pulsator is broken by an inner pulsator in order to prevent tangling and twisting of laundry articles and to improve efficiency of washing.

To achieve the above object, the present invention provides a washing machine with a double pulsator comprising:

- a washing tub coaxially connected with a stationary tub, the washing tub being rotatable on a rotating shaft and having a plurality of washing water communication holes;
- an outer pulsator mounted on the bottom of the washing tub which, the outer pulsator having a hollow protruding part protruded upwardly at a center thereof and a bottom plate extended in a radial direction from a lower skirt of the protruding part;
- an inner pulsator installed inside of the protruding part, the inner pulsator having a rotating shaft part formed at a center thereof and revolving wings formed on an outer circumferential surface of the rotating shaft part; and
- a gear part having an inner gear formed under the inner pulsator, an outer gear formed under the outer pulsator, and an intermediate gear engaged between the inner gear and the outer gear and interlocking the inner gear and the outer gear.

The inner gear is rotated by driving of the driving motor which is connected with a central axis of the inner gear, and the outer gear is rotated in an reverse direction to a rotating direction of the inner gear.

The protruding part of the outer pulsator has a plurality of communication holes through which washing fluid flows freely, so that a current generated by the inner pulsator can pass through the communication holes of protruding part of outer pulsator and then break a current generated by the outer pulsator.

The outer pulsator has a plurality of ribs formed on the bottom plate thereof for generating a current, and a plurality of communication holes piercing the bottom plate through which washing fluid flows freely.

The inner gear is formed coaxially under the inner pulsator and is shaped like a round plate, the outer gear is formed integrally under the outer pulsator and is an internal gear, and the intermediate gear is simultaneously engaged with the inner gear and the outer gear, so that when the inner gear is rotated by the driving motor, the outer gear is rotated in a reverse direction to a rotating direction of the inner gear by the intermediate gear.

According to the washing machine with the double pulsator of the present invention, during the washing operation a heart-shaped vortex current generated by an outer pulsator is broken by a reverse current generated by an inner pulsator, and consequently tangling and twisting of laundry articles are prevented.

According to the washing machine with the double pulsator of the present invention, during the washing operation, a current which is generated in the lower part of the washing tub by an outer pulsator and a reverse current which is generated at the upper part of the washing tub make a random and irregular current in the washing tub. As a result, the laundry articles are struck by washing water in random directions so laundry articles will be washed with the effect in which the laundry is rubbed and beaten in various directions. As a result, efficiency of washing is largely improved.

According to the washing machine with the double pulsator of the present invention, during the washing operation, a reverse current generated by the inner pulsator can go out through a plurality of communication holes of protruding part of outer pulsator, so that laundry articles are washed by being beaten with random and irregular water current rather than by being rubbed directly against the protruding part. Therefore, laundry articles are damaged less.

BRIEF DESCRIPTION OF THE DRAWINGS

The above objects and other advantages of the present invention will become more apparent by describing in detail preferred embodiments thereof with reference to the attached drawings in which.

DESCRIPTION OF THE PREFERRED EMBODIMENTS

Hereinafter, the present invention will be described in detail with reference to the accompanying drawings.

Figure 1:
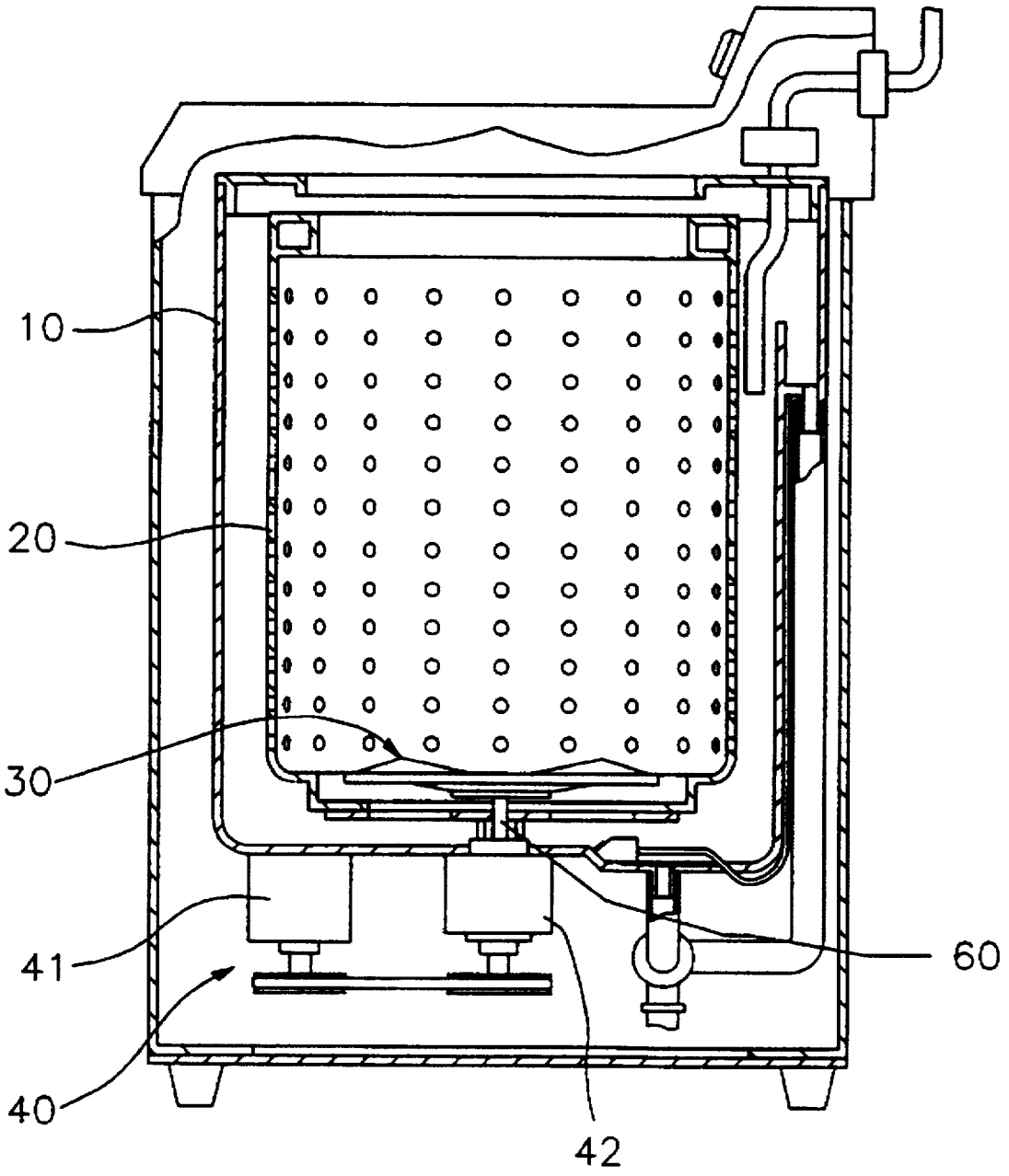
FIG. 1 PRIOR ART
FIG. 1 is a schematic cross-sectional view of a one-tub type washing machine with a pulsator according to the prior art.
Figure 2:
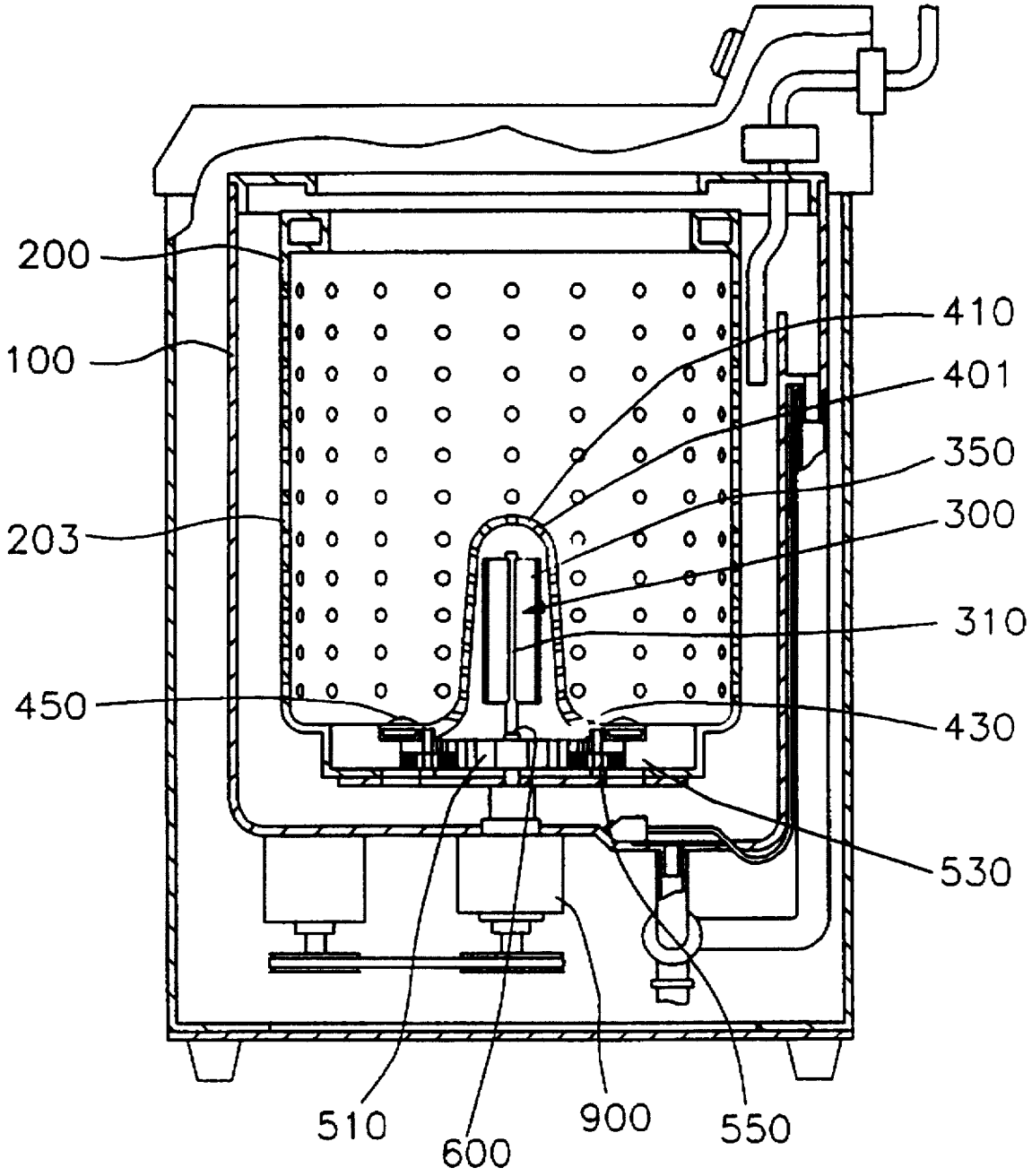
FIG. 2 is a schematic cross-sectional view of a washing machine with a double pulsator according to the present invention.
Figure 3:
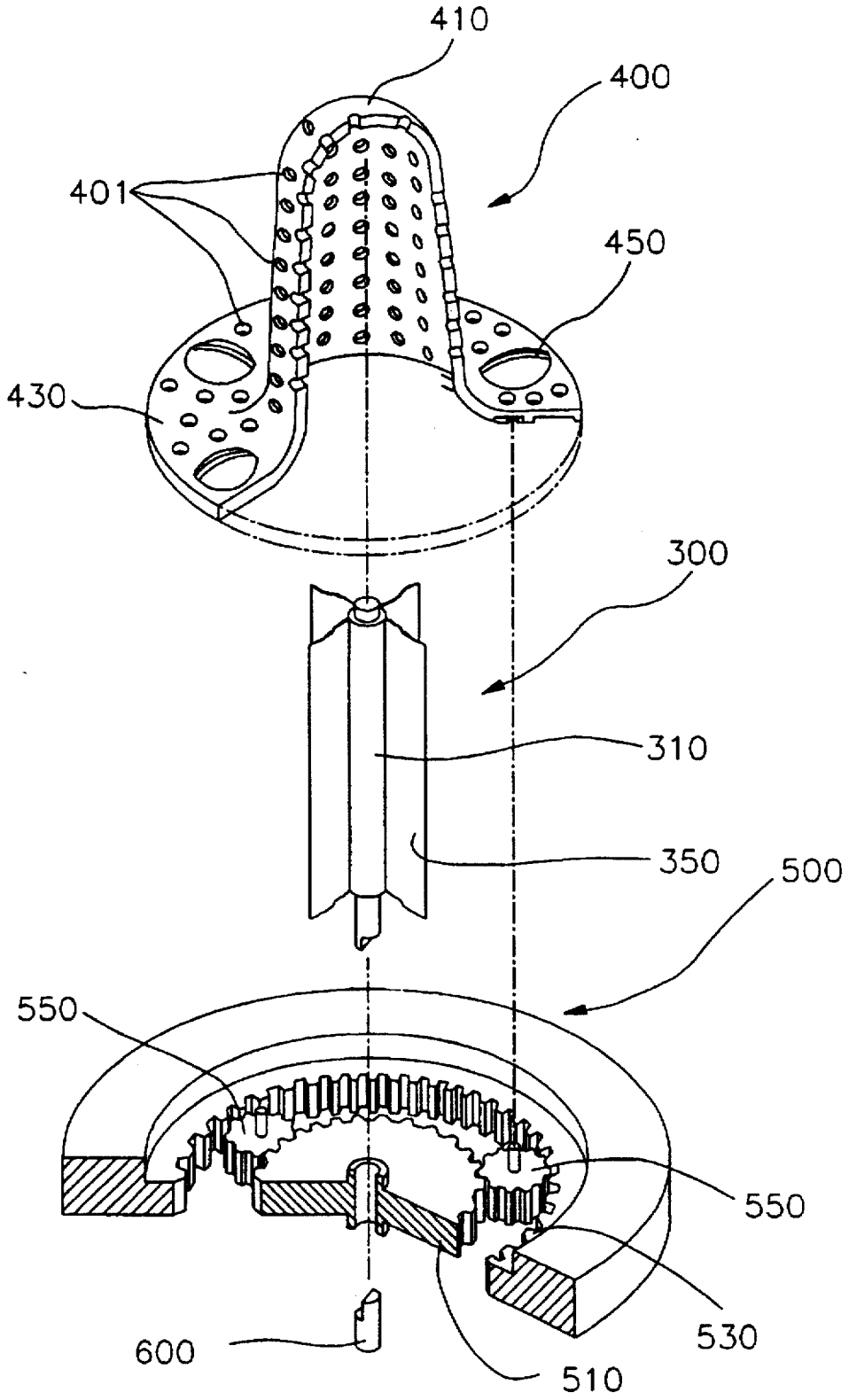
FIG. 3 is an exploded and enlarged perspective view of an outer pulsator, an inner pulsator, and a gear part in the washing machine of FIG. 2.

FIG. 2 is a schematic cross-sectional view of a washing machine with a double pulsator according to the present invention, and FIG. 3 is an exploded and enlarged perspective view of an outer pulsator, an inner pulsator, and a gear part in the washing machine of FIG. 2.

As shown in FIGS. 2 and 3, reference numeral 100 denotes a stationary tub for receiving washing water. A rotating shaft 600 is upwardly installed at the center of the bottom thereof. A driving part 900 is installed under the stationary tub 100 to rotate the rotating shaft 600.

A washing tub 200, which has a plurality of washing water communication holes 203, is deposited in stationary tub 100 and is rotatable on rotating shaft 600 coaxially with stationary tub 100.

An inner pulsator 300 is installed at the bottom center in the washing tub 200 coaxially with rotating shaft 600. The inner pulsator 300 is mounted in a rotatable state on the rotating shaft 600, thus depending on rotation of the rotating shaft 600.

The inner pulsator 300 has a rotating shaft part 310 formed at a center thereof and revolving wings 350 formed on a outer circumferential surface of the rotating shaft part 310.

An outer pulsator 400 is mounted rotatably on the bottom inside of the washing tub 200. The outer pulsator 400 has a hollow protruding part 410 protruded upwardly at a center thereof and a bottom plate 430 extended in a radial direction from a lower skirt of the protruding part 410.

The protruding part 410 of the outer pulsator 400 has a plurality of communication holes 401 through which washing fluid flows freely. Thus, a current which is generated by the inner pulsator 300 goes out through the communication holes 401 of protruding part 410 of outer pulsator 400.

The outer pulsator 400 has a plurality of ribs 450 formed on the bottom plate 430 thereof for generating a current, and has a plurality of communication holes 401 piercing the bottom plate 430 through which washing fluid flows freely.

The outer pulsator 400 is positioned so that the inner pulsator 300 is placed inside of the protruding part 410.

A gear part 500 is installed under the inner pulsator 300 and the outer pulsator 400. An inner gear 510 of the gear part 500 is shaped like a round plate. The inner gear 510 is formed coaxially on the rotating shaft 600 under the inner pulsator 300, and rotated integrally with the inner pulsator 300 when the rotating shaft 600 rotates.

The outer gear 530 of the gear part 500 is installed under the outer pulsator 400, and is an internal gear with a central opening, of which the diameter of the opening is larger than that of the inner gear 510. The outer gear 530 is formed coaxially on the rotating shaft 600 and the inner gear 510, and rotated in the reverse direction to the rotating direction of the inner gear 510 integrally with the outer pulsator 400 arranged thereupon.

The gear part 500 has one or more intermediate gears 550 engaged between the inner gear 510 and the outer gear 530 and interlocking the inner gear 510 and the outer gear 530.

Thus, when the inner gear 510 is rotated by the driving part 900, the outer gear 530 is rotated in the reverse direction to a rotating direction of the inner gear 510 by the intermediate gear 550 therebetween.

Hereinbelow, the operation of the washing machine with a double pulsator according to the present invention constructed as above will be described.

In the event of washing operation, a driving part 900 is driven in the state that the washing water fills to the desired amount in stationary tub 100. Rotating shaft 600 installed at the center of the bottom of stationary tub 100 is rotated, for example, in a clockwise direction by driving the driving part 900.

The rotating shaft part 310 of the inner pulsator 300 coaxially installed on the rotating shaft 600 is rotated integrally with the rotating shaft 600 in a clockwise direction depending on rotation of the rotating shaft 600.

Thus, the clockwise swirling currents generated by rotation of the rotating wings 350 of the inner pulsator 300 is pushed out through the communication holes 401 of the protruding part 410 of the outer pulsator 400.

During this time, the inner gear 510 is rotated in a clockwise direction integrally with the inner pulsator 300 installed thereupon. The intermediate gears 550 engaged with the inner gear 510 are rotated in a counterclockwise direction. The internal gear 530 engaged with the intermediate gear 550 is rotated in a counterclockwise direction.

The outer pulsator 400 engaged with the internal gear 530 is also rotated in a counterclockwise direction. Since the ribs 450 formed on the bottom plate 430 of the outer pulsator 400 are rotated in a counterclockwise direction, washing water in the washing tub is rotated in a counterclockwise direction, pushed out radially, and then moved toward the upper part along the inside wall surface of the washing tub, thus generating a heart-shaped counterclockwise vortex current in the washing tub 200.

The heart-shaped counterclockwise vortex current generated by the outer pulsator 400 on the bottom of the outer pulsator 400 is broken by the clockwise current generated by the inner pulsator 300 in the middle of the washing tub 200, and thus the random and irregular current is formed in the washing tub 200.

If the rotating direction of the inner pulsator 300 is changed into a reverse direction, i.e., counterclockwise direction, the outer pulsator 400 generates a heart-shape clockwise vortex current. Thus the random and irregular current is formed in the washing tub 200.

During the washing operation, the inner pulsator 300 and the outer pulsator 400 change repeatedly into clockwise and counterclockwise directions, whereby washing operation is carried out.

According to the washing machine with the double pulsator of the present invention, during the washing operation, a heart-shaped vortex current generatedby an outer pulsator is broken by a reverse current generated by an inner pulsator, and consequently tangling and twisting of laundry articles are prevented.

According to the washing machine with the double pulsator of the present invention, during the washing operation a current which is generated in the lower part of the washing tub by an outer pulsator and a reverse current which is generated at the upper part of the washing tub make a random and irregular current in the washing tub, and thus, the laundry articles are struck by washing water in random directions and laundry articles can be washed with the effect in which the laundry is rubbed and beaten in various directions. As a result, efficiency of washing is largely improved.

According to the washing machine with the double pulsator of the present invention, during the washing operation a reverse current generated by the inner pulsator can go out through a plurality of communication holes of protruding part of outer pulsator, so that laundry articles are washed by being beaten with random and irregular water currents rather than by being rubbed directly against the protruding part. Therefore, laundry articles are damaged less.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A washing machine with a double pulsator comprising:

a stationary tub for holdinq a level of washing fluid;

a washing tub coaxially connected with the stationary tub inside the stationary tub, the washing tub being rotatable on a first rotational shaft and having a plurality of washing water communication holes;

an outer pulsator rotatably mounted on a bottom part of the washing tub for generating a first vortex current within the washing tub, the outer pulsator having a hollow protruding part protruded upwardly and a bottom plate radially extended from a lower part of the protruding part;

an inner pulsator rotatably installed inside of the protruding part of the outer pulsator for generating a second vortex current within the washing tub, the inner pulsator having a rotational shaft part which is formed on the first rotational shaft of the washing tub, and a plurality of revolvable wings radially arranged on an outer surface of the rotational shaft part for generating the second vortex current;

a gear part having an inner gear formed at a lower portion of the rotational shaft part of the inner pulsator, an outer gear formed at a lower portion of the outer pulsator, and an intermediate gear engaged between the inner gear and the outer gear and interlocking the inner gear with the outer gear; and driving means for rotating the first rotational shaft;

wherein, the inner gear connected with the first rotational shaft is rotatable in a same direction to the first rotational shaft by means of the driving means so the inner pulsator connected with the inner gear is rotatable in the same direction to the inner gear, while the outer gear is rotatable in an inverse direction to the inner gear due to the intermediate gear so the outer pulsator connected with the outer gear is rotatable in the inverse direction to the inner pulsator.

2. A washing machine as claimed in claim 1, wherein the protruding part of the outer pulsator has a plurality of communication holes through which washing fluid flows freely, so that a current generated by the inner pulsator can pass through the communication holes of protruding part of outer pulsator and then break a current generated by the outer pulsator.

3. A washing machine as claimed in claim 1, wherein the outer pulsator has a plurality of ribs formed on the bottom plate thereof for generating a current.

4. A washing machine as claimed in claim 1, wherein the outer pulsator has a plurality of communication holes piercing the bottom plate through which washing fluid flows freely.

5. A washing machine as claimed in claim 1, wherein the inner gear is formed coaxially and integrally with the inner pulsator and is a circular gear.

6. A washing machine as claimed in claim 1, wherein the outer gear is formed coaxially and integrally with the outer pulsator, and the outer gear is an internal gear.

7. A washing machine with a double pulsator comprising:

a stationary tub for holding a level of washing fluid;

a washing tub coaxially connected with the stationary tub inside the stationary tub, the washing tub being rotatable on a first rotational shaft and having a plurality of washing water communication holes;

an outer pulsator rotatably mounted on a bottom part of the washing tub for generating a first vortex current within the washing tub, the outer pulsator having a hollow protruding part protruded upwardly and a bottom plate radially extended from a lower part of the protruding part, the protruding part having a plurality of communication holes through which washing fluid flows freely, the bottom plate being provided with a plurality of ribs formed on an upper surface of the bottom plate for generating the first vortex current;

an inner pulsator rotatably installed inside of the protruding part of the outer pulsator for generating a second vortex current within the washing tub, the inner pulsator having a rotational shaft part which is formed on the first rotational shaft of the washing tub, and a plurality of revolvable wings radially arranged on an outer surface of the rotational shaft part for generating the second vortex current;

a gear part having an inner gear formed at a lower portion of the rotational shaft part of the inner pulsator, an outer gear formed at a lower portion of the outer pulsator, and an intermediate gear engaged between the inner gear and the outer gear and interlocking the inner gear and the outer gear, the inner gear being formed coaxially and integrally with the inner pulsator and being a circular gear, and the outer gear being formed coaxially and integrally with the outer pulsator and being an internal gear; and driving means for rotating the first rotational shaft, wherein, the inner gear connected with the first rotational shaft is rotatable in a same direction to the first rotational shaft by means of the driving means so the inner pulsator connected with the inner gear is rotatable in the same direction to the inner gear, while the outer gear is rotatable in an inverse direction to the inner gear due to the intermediate gear so the outer pulsator connected with the outer gear is rotatable in the inverse direction to the inner pulsator, so that the first vortex current generated by the outer pulsator and the second vortex current generated by the inner pulsator collide with each other to form a complex current.

* * * * *